United States Patent [19]

Komma et al.

[11] 4,042,010

[45] Aug. 16, 1977

[54] APPARATUS FOR WITHDRAWAL OF CONTINUOUSLY CAST INGOTS

[75] Inventors: Gerhard Komma, Dinslaken-Hiesfeld; Hans Schrewe, Duisburg, both of Germany

[73] Assignee: Mannesmann Aktiengesellschaft, Dusseldorf, Germany

[21] Appl. No.: 643,147

[22] Filed: Dec. 22, 1975

[30] Foreign Application Priority Data

Dec. 20, 1974 Germany ..... 2461045

[51] Int. Cl.[2] ..... B22D 11/12

[52] U.S. Cl. ..... 164/282

[58] Field of Search ..... 164/282, 82, 283 S

[56] References Cited

U.S. PATENT DOCUMENTS

| | | | |
|---|---|---|---|
| 3,543,830 | 12/1970 | Baumann | 164/282 X |
| 3,776,298 | 12/1973 | Vogt | 164/282 X |
| 3,918,514 | 11/1975 | Schoffmann | 164/282 X |

FOREIGN PATENT DOCUMENTS

| | | | |
|---|---|---|---|
| 13,511 | 1/1971 | Japan | 164/282 |

*Primary Examiner*—Robert D. Baldwin

*Attorney, Agent, or Firm*—Ralf H. Siegemund

[57] ABSTRACT

The rolls of a curved withdrawal path for an ingot emerging from a continuous casting mold are resiliently yieldingly supported on the outside curved track as between bending and straightening points, while rolls continuing the inside track beyond the first point of straightening the ingot and into the horizontal are also yieldingly mounted, while the respective opposite rolls are rigidly mounted.

4 Claims, 3 Drawing Figures

APPARATUS FOR WITHDRAWAL OF CONTINUOUSLY CAST INGOTS

BACKGROUND OF THE INVENTION

The present invention relates to continuous casting and more particularly to improvements in the withdrawing of an ingot as emerging from a straight or curved mold, veering the ingot towards a horizontal direction and straightening the ingot before it is moved into the horizontal direction for further processing.

Machines for continuous casting of steel, for example, are usually provided with roll tracks being disposed underneath the mold for withdrawing the ingot from the bottom of the mold and guiding the ingot along a curved withdrawl path. The ingot is usually guided here by means of rigidly mounted support rolls of the track arranged along the outer guiding path, while guiding and support rolls on the inside of the curved track are hydraulically or otherwise resiliently mounted, singly or in groups. This movability of the inside rolls serves for adjustment of the machine to different thicknesses of the ingot. Also, the ingot blank or stool for starting the machine may differ in its dimensions relative to the ingot that follows. These inner guide and support rolls are usually movable in the direction towards the radial center of the curved ingot path. As stated, the outer guide rolls are fixed with regard to their position in relation to the ingot path as such. It has to be observed here that these outer rolls may cause also some bending of the ingot into the curved portion of the withdrawal path.

These known machines have the drawback that particularly in the beginning and towards the end of a casting run the outer guide rolls are overloaded. This is true generally and noticable particularly, if the radius of curvature is changed to bend the ingot in steps. Overloading is specifically the result of the fact that the beginning and the end portions of the ingot are relatively cool, and bending exerts considerably forces on any rigidly mounted guide roll. This is also true with regard to rolls which straighten the ingot, when it leaves the curved withdrawal path or when entering a track portion of a lesser curvature. Tests have shown that several guide rolls are overloaded by bending and straightening of about 0.3 to half a meter of the first or beginning portion of the ingot and by about half a meter length of the end portion thereof. As a consequence, these overloaded guide rolls wear very rapidly and are often damaged fairly soon following first use.

DESCRIPTION OF THE INVENTION

It is an object of the present invention to provide a withdrawal path for continuously cast ingots which permits bending and straightening of the ingot without damage to the rolls of the track that define and establish the withdrawal path.

It is a specific object of the present invention to improve the construction of a roll track withdrawal path for ingots in a continuous casting machine which withdrawal path is defined by two roll tracks and includes a curved portion which is continued into a straight, horizontal configuration.

In accordance with the preferred embodiment of the present invention, reference is made specifically to the point of bending or the first point of a zone of bending, the withdrawn ingot into a curved contour; and further reference is made to a point, or the first point of a zone, in which the ingot is straightened in one or several steps. It is suggested to provide for resilient yielding of the withdrawal rolls, which guide and support the ingot along the outside path of curvature as between the respective first points and to resiliently support those withdrawal rolls in and beyond the first point of straightening and which support and guide the ingot from above. The invention is applicable to straight as well as curved molds. In the latter case, only slight bending occurs and the rule as to mounting the outer track path rolls apply right from the bottom of the mold from which the ingot emerges.

The respective rolls could be resiliently supported individually or in groups. Generally speaking, the direction of resilient support will have a radial component as regards the curving of the withdrawl path, but the rolls on the outside may be urged against the ingot in strictly horizontal direction immediately below the zone or the first zone of bending, and in strict vertical direction just ahead of the (first) straightening point or zone.

The resilient support may be provided by means of hydraulic or pneumatic cushioning elements which act either as active positioning elements for such rolls or as passive cushions. As regards the beginning and the end of the ingot, conditions may require load relief on the resiliently supported rolls and e.g. the pressure in the hydraulic or pneumatic positioning elements may be controlled accordingly. It may even be necessary to retract these rolls prior to passage of the beginning and also just prior to passage of the end of the ingot, with normal conditions (normal pressure) being established after the beginning of the end has passed. In cases, however, it may be desirable to acutally exert a greater bending force on the beginning and end portions of the ingot, of course, within the strength limits of the respective support rolls.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows a mold 4 for continuous casting of a steel ingot 5. The ingot emerges from the bottom of the mold and is withdrawn by means of rolls arranged in two tracks having respectively guide and support rolls 1 and 2. These rolls engage the ingot 5 from different sides and guide it along a particular curved withdrawal path.

Figure 1:
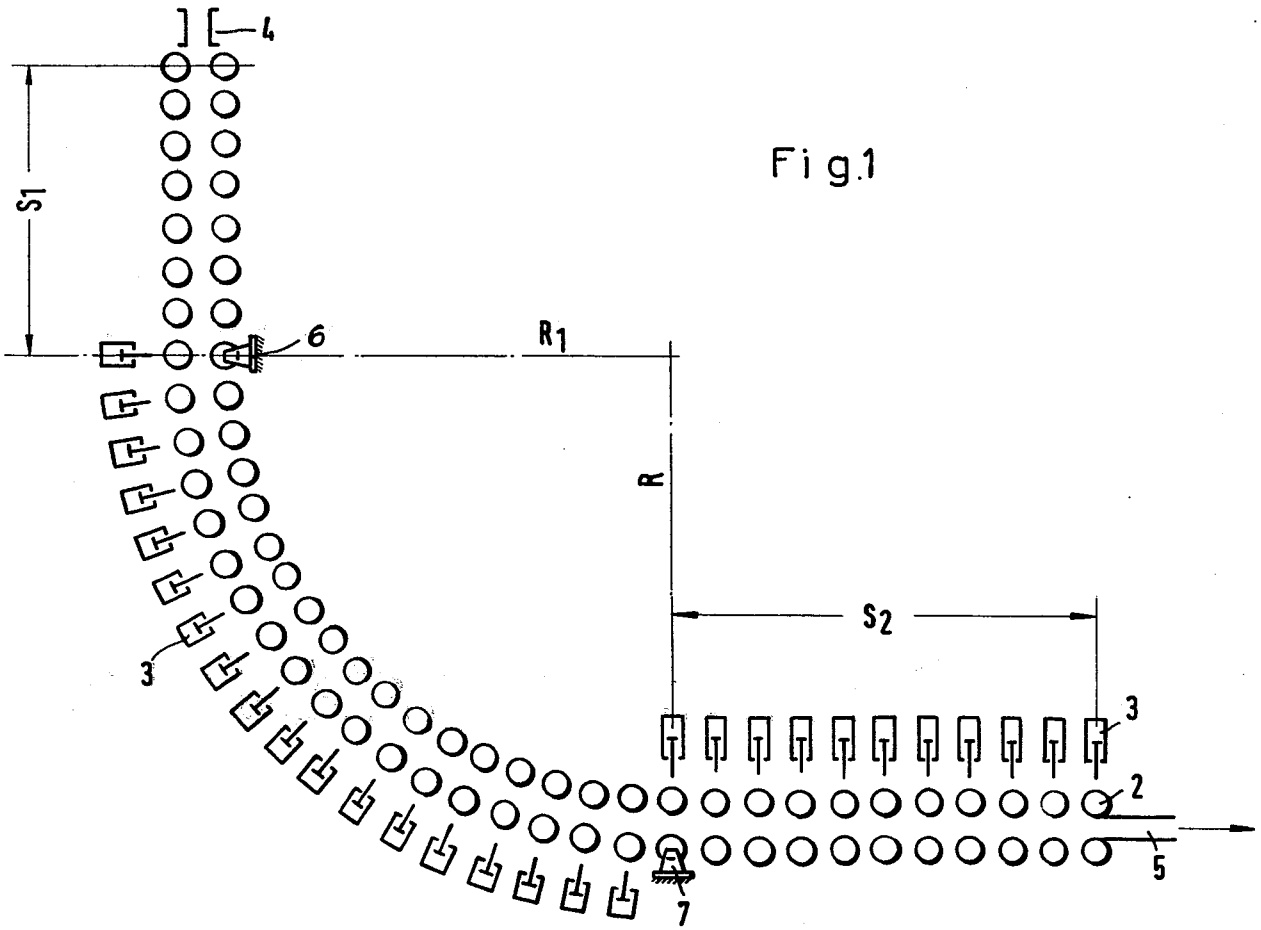
FIG. 1 is a schemetic side elevation of a complete ingot withdrawal system.

The withdrawal path can be (in this instance) divided into three portions. Since it is presumed for this paarticular example that the mold cavity is a straight one, the first portion $S_1$ of the withdrawal path has a lengthwise straight vertical orientation. Following that first portion is a second portion in which the path curves to veer the ingot from the vertical to the horizontal along a curved withdrawal track. In the third portion $S_2$ the ingot runs in the horizontal direction.

Reference numeral 6 refers to the point or zone of bending the straight ingot to assume a curved configuration with a median radius of curvature $R_1$. Reference numeral 7 refers to the point or zone of straightening the ingot. The particular equipment, however, is somewhat simplified. Thus, point or zone 6 may actually be the first of several points of bending, so that the radius of curvature of the ingot is gradually decreased, while point or zone 7 may be the first one of several points of straightening and such a first point would merely increase the radius of curvature, but to less than infinity.

Now in accordance with the invention, the outer rolls 2 (outer, on account of the curving) from the point or zone 6 to the point or zone 7 are yieldingly supported by and on control elements 3, such as hydraulic or pneumatic drives with a radial orientation of the direction or displacement and yielding. Those of the rolls 1, which extend from the point or zone 7 onward along the horizontal withdrawal path are likewise yieldingly supported by such elements 3 and here the yielding direction is a vertical one. The inside rolls on the track between points 6 and 7 and the lower support rolls from the point 7 on are rigidly mounted.

The control elements 3 may be active ones or passive ones, as stated. In the former case, they serve additionally for positioning the rolls individually or in groups, but in either case they provide for a hydraulic elastic cushioning. The pressure in cylinders or drives 3 should be controlled to provide relief in the phases of passage of the beginning and of the end of the casting, while during passage of the main portion of the ingot the pressure is provided to a normal level. However, the pressure could be actually increased during passage of the beginning and of the end of the ingot. One must take care here to select a pressure that does not exceed the strength of the respective roll. Increased pressure may be desirable for purposes of increasing the bending force and/or the straightening force.

Figure 2:
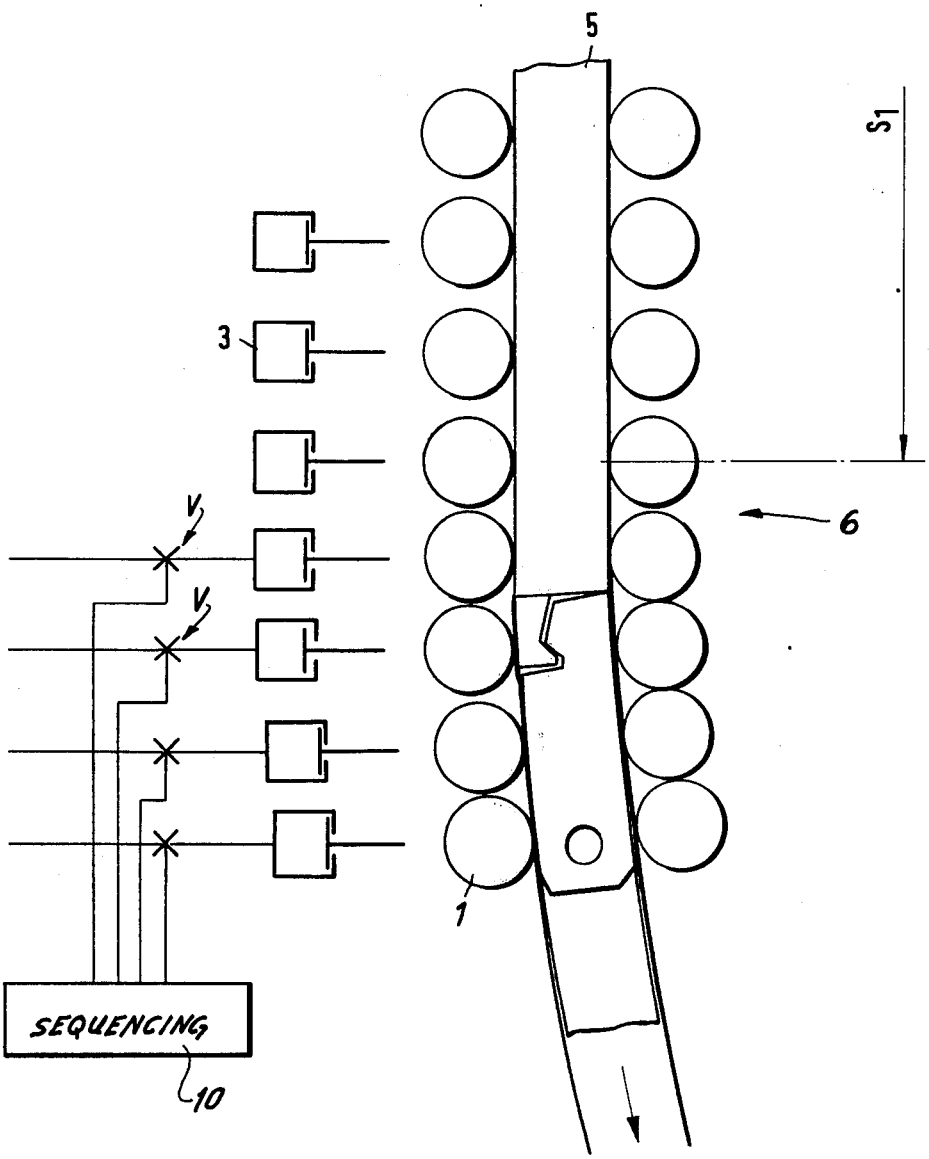
FIG. 2 is a similar view, but of a portion only of FIG. 1 and on an enlarged scale involving particularly the transition from a vertical to a curved path of and in the withdrawal path.
Figure 3:
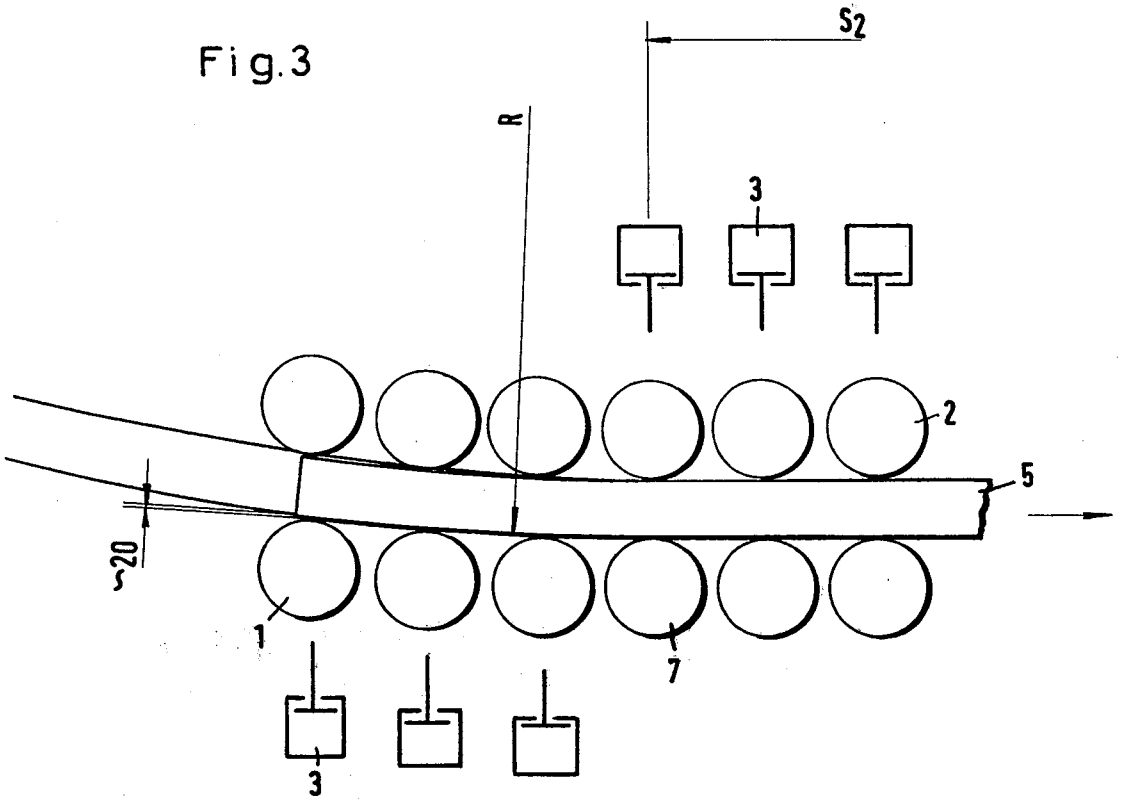
FIG. 3 is a view still similar to FIG. 1, but also on an enlarged scale and depicting the portion of transition from the curved path to the horizontal portion of the withdrawal system.

FIG. 2 shows the beginning of casting with a descending stool followed by an ingot 5 as it just about enters zone 6. FIG. 3 shows the end of the casting as it is just about to pass through zone 7.

Concerning FIG. 2 it should be noted that the zone 6 actually covers a few rolls, i.e. the bending is a gradual one; the radius of curvature is not abruptly forced upon the ingot. This can be obtained by gradually increasing the pressure of the respective cylinders 3 in horizontal direction.

FIG. 2 shows also somewhat schematically a sequencing control device 10 which controls in sequence valves V by means of which pressure medium flow and exhaust is controlled as to each individual hydraulic or pneumatic drive element 3. It can be seen that normally maximum pressure is maintained in the respective cylinders to force the respective piston whose piston rod carries the respective roll, to have maximum protected position. The sequencer, however, provides for temporary load relief by lowering the pressure in individual drives 3, increasing, therefore, the cushioning and resilient yielding as provided by the particular drive, particularly of the piston thereof and, therefore, of the respective roll 1.

As can be seen from the disposition of the various plungers in the drawing relief in that respect and a reduced pressure is established for those of the drives, which support rolls past which the beginning of the ingot is just about to pass. The sequencer, possibly but not necessarily, operates in direct dependence upon the progression of the stool and moves that particular control state from drive to drive as the beginning of the ingot progresses down the curved pass. In reality, this can be carried out by observation or scanning the passage of that stool.

The situation is analogous with regard to the rolls in or near the zone 7 as shown in FIG. 3. The figure depicts particularly the passage of the end of the ingot. The sequencing operates analogously. In other words, the sequencer runs through its sequence twice for each casting run; first in the beginning and again after the end emerges of the bottom of the mold.

In this particular instance as shown in FIG. 3 it is presumed that the end of the ingot passes just one particular roll, and it can be seen from the position of the piston therein that the pressure has been relieved, so that some cushioning is provided, and this particular roll yields more readily than the others. The sequencer will continue the temporary pressure relief operation for the drive element 3 which position and cushion the upper rolls 2 from the straightening point or zone 7 onward.

It will be appreciated that this description is by way of example only and the control of each individual drive element 3 can be matched to the requirements concerning the particular roll pressure needed under any of the various circumstances and conditions that may arise, and this includes e.g. increasing rather than decreasing the holding pressure while a normal pressure provides for a larger yielding and cushioning than the special case of increasing the bending and straightening force by the time beginning and/or end of the ingot passes.

FIGS. 2 and 3 illustrate also a slight moidification or refinement as compared with the overall view of FIG. 1. The cylinders 3 urge rolls 1 in horizontal direction in the vicinity of zone 6 and not in radial direction. Analogously, the cylinders of drives 3 urge rolls 1 in a straight vertical direction near zone 7. However, for the bulk of the rolls 1 along the curved path the direction of force exertion should be substantially radial.

The disposition, support, and control of the several rolls, particularly the outside support rolls along the curved withdrawal path and of the rolls above the ingot beyond the first straightening zone avoids damage to these rolls, which, of course, reduces down time of the machine.

The invention is not limited to the embodiments described above, but all changes and modifications thereof not constituting departures from the spirit and scope of the invention are intended to be included.

We claim:

1. In a continuous casting machine having a mold and a roller track for withdrawing and guiding an ingot from a vertical or substantially vertical direction of immediate withdrawal, to a horizontal direction of withdrawal, the roller track and withdrawal path being curved in between an arrangement of rolls, providing for at least one point or a first point of bending the ingot into the curved path and there being at least one point or a first point of straightening the ingot from the curved path into a straight horizontal path, the improvement comprising:

a first plurality of the rolls being disposed on an outside path of the track and extending from said one or first bending point to said one or the first straightening point, there being means for resiliently-yielding mounting the rolls of the first plurality of rolls with at least a component of movement in radial direction with regard to curving of the path and track;

a second plurality of the rolls being disposed in continuation of an inside path of the track in and beyond said one or first point of straightening in the direction of withdrawing, there being means for resiliently-yieldingly mounting the rolls of the second plurality of rolls with at least a component of movement in vertical direction;

a third plurality of rolls being disposed on an inside path of the track and extending from said one or first bending point to said one or the first straightening point, there being means for rigidly mounting the rolls of the third plurality of rolls; and a fourth plurality of rolls being disposed on an outside path of the track in and beyond said one or first point of straightening in the direction of withdrawing, there being means for rigidly mounting the rolls of the fourth plurality of rolls.

2. In a machine as in claim 1 and including means for controlling the resiliency of mounting of said rolls of said pluralities of rolls, in dependence upon passage of a beginning, an end and the portion of the ingot in-between the beginning and the end of the ingot.

3. In a machine as in claim 1, several of the rolls of the first plurality of rolls being mounted beyond said first point in the curved path for yielding in straight horizontal direction.

4. In a machine as in claim 1, several rolls of the first plurality of rolls being mounted ahead of said first point of straightening, for yielding in straight vertical direction.

* * * * *